US005899782A

United States Patent [19]

Martin

[11] Patent Number: 5,899,782

[45] Date of Patent: May 4, 1999

[54] STEERABLE, TOWABLE FLOTATION DEVICE

[76] Inventor: Don J. Martin, 2204 Young St., Bellingham, Wash. 98225

[21] Appl. No.: 08/854,307

[22] Filed: May 12, 1997

[51] Int. Cl.[6] ..... B63B 35/73

[52] U.S. Cl. ..... 441/66; 114/253; 441/67

[58] Field of Search ..... 114/253, 254, 114/345; 441/65, 66, 67, 72, 73

[56] References Cited

U.S. PATENT DOCUMENTS

| | | | |
|---|---|---|---|
| 398,631 | 2/1889 | Lässoe . | |
| 2,334,072 | 11/1943 | Cooper | 114/345 |
| 2,496,460 | 2/1950 | Evans | 441/66 |
| 2,568,549 | 9/1951 | Kluttz | 9/11 |
| 2,920,598 | 1/1960 | Nielsen | 114/235 |
| 3,042,944 | 7/1962 | Basey et al. | 114/253 |
| 3,045,264 | 7/1962 | Smith | 9/310 |
| 3,434,167 | 3/1969 | Del Vecchio et al. | 441/67 |
| 3,455,571 | 7/1969 | Dallera et al. | 280/18 |
| 3,581,328 | 6/1971 | Smith | 9/310 |
| 3,592,468 | 7/1971 | Stoemdinger, Jr. | 273/1 |
| 3,657,753 | 4/1972 | LeBlanc, Sr. | 9/310 F |
| 3,664,290 | 5/1972 | Finn | 115/20 |
| 3,666,265 | 5/1972 | Ammerman et al. | 271/36 |
| 3,779,201 | 12/1973 | Spahn | 115/20 |
| 3,803,652 | 4/1974 | Uyehara | 9/310 E |
| 3,803,653 | 4/1974 | Trostad | 9/310 C |
| 3,807,342 | 4/1974 | Turner | 114/235 |
| 3,824,945 | 7/1974 | Casciano | 114/235 |
| 3,950,808 | 4/1976 | Sorenson | 9/310 |
| 4,030,151 | 6/1977 | McKeen, Jr. | 9/1.7 |
| 4,206,933 | 6/1980 | Koch | 280/18 |
| 4,302,003 | 11/1981 | Hughes . | |
| 4,389,961 | 6/1983 | Parish | 114/345 |
| 4,427,394 | 1/1984 | Felter | 441/66 |
| 4,451,239 | 5/1984 | Hoenstine et al. | 441/66 |
| 4,552,539 | 11/1985 | Hoenstine et al. | 441/66 |
| 4,565,148 | 1/1986 | Verhoosel | 114/242 |
| 4,606,728 | 8/1986 | Simpson | 441/66 |
| 4,613,311 | 9/1986 | Wood | 441/130 |
| 4,619,621 | 10/1986 | Coleman, IV | 441/66 |
| 4,635,581 | 1/1987 | Scheurer | 441/67 |
| 4,756,700 | 7/1988 | Coleman | 441/65 |
| 4,762,316 | 8/1988 | Merino | 272/56.5 |
| 4,807,554 | 2/1989 | Chi-Hung | 114/345 |
| 4,820,219 | 4/1989 | Fortier, Jr. et al. | 441/66 |
| 4,886,476 | 12/1989 | Brocone et al. | 441/65 |
| 4,942,839 | 7/1990 | Chuan | 114/345 |
| 5,006,087 | 4/1991 | Peterson | 441/66 |
| 5,009,183 | 4/1991 | Naypaver | 114/253 |
| 5,080,620 | 1/1992 | Reden | 441/68 |
| 5,083,955 | 1/1992 | Echols | 441/65 |
| 5,101,752 | 4/1992 | Smollar et al. | 114/345 |
| 5,122,086 | 6/1992 | Remy | 441/66 |
| 5,154,655 | 10/1992 | Glydon | 441/65 |
| 5,279,510 | 1/1994 | Remy | 441/67 |
| 5,351,637 | 10/1994 | Brenckmann | 114/39 |
| 5,383,804 | 1/1995 | Mitch et al. | 441/66 |
| 5,462,001 | 10/1995 | Lemelson | 114/253 |
| 5,507,674 | 4/1996 | Yeung | 441/131 |
| 5,518,431 | 5/1996 | Staley | 441/130 |
| 5,525,083 | 6/1996 | Reich | 441/68 |

FOREIGN PATENT DOCUMENTS

| | | | |
|---|---|---|---|
| 609860 | 12/1960 | Canada | 114/253 |
| 40 07 645 A 1 | 9/1991 | Germany | 114/253 |

*Primary Examiner*—Sherman Basinger
*Attorney, Agent, or Firm*—Michael R. Schacht; Hughes & Schacht, P.S.

[57] ABSTRACT

The present invention is a water sport device that is easy to use and may be steered. This device comprises a flotation assembly, a connecting member, and a connecting assembly, where the connecting member is attached to a front portion of the flotation assembly. The connecting assembly moves along the connecting member to change an effective attachment point of a towline to the flotation assembly. Sponsons are preferably arranged on the underside of the flotation assembly. These sponsons are preferably toed in to provide a rearwardly diverging channel between them. Outer surfaces of the sponsons are outwardly and upwardly canted to allow the entire device to move side to side in the water. A handle assembly is provided that allows the rider to move the position of the connecting assembly relative to the connecting member.

22 Claims, 8 Drawing Sheets

STEERABLE, TOWABLE FLOTATION DEVICE

TECHNICAL FIELD

The present invention relates to flotation devices that are designed to be towed behind a boat for pleasure and, more specifically, to a flotation device that is steerable to allow the rider to go in directions other than that in which the boat is moving.

BACKGROUND OF THE INVENTION

A popular warm weather activity is to be pulled behind a powered watercraft on skis, knee boards, inner tubes, and other devices. Water skis and similar towed devices allow the user to change direction behind the power boat; this allows the skier to perform stunts such as jumping the wake and the like.

Other towed water sport devices, such as inner tubes, are simply connected to the boat by a tow line and dragged behind the boat. These devices cannot be steered in the same manner as water skis, and thus the type of ride is much more passive than that provided to a water skier.

To allow an inner tuber to have an experience similar to that of a water skier, it would be highly desirable to obtain an inner tube or other similar flotation device that can be steered in directions other than that of the boat.

OBJECTS OF THE INVENTION

From the foregoing, it should be apparent that one primary goal of the present invention is to obtain improved devices that are designed to be towed behind a boat for the enjoyment of the rider.

Another more specific object of the invention is to obtain a steerable, towable flotation device having a favorable mix of the following characteristics:

- allows the device to be steered such that the device can move in directions other than that of the direction of travel of the boat;
- simple in construction and operation;
- configured to obtain the benefits of conventional inner tube flotation devices;
- allows a rider to sit or lay while riding; and
- stable when moving and/or at rest.

SUMMARY OF THE INVENTION

These and other objects are obtained by the present invention, which is a flotation device employing a connecting system that allows the point at which the tow line is attached to the flotation device to be moved, one or more sponsons attached to the underside of the flotation device, and a handle assembly that allows a rider to move the point of attachment of the tow line. Together, these features work as a steering system that allows the direction of travel of the flotation device to be moved relative to that of the boat. Some benefits of the present invention may be obtained by using any one of these features alone.

The connecting system comprises a connecting member that is attached to the flotation device such that it extends across a front portion thereof and a connecting assembly that is secured to the tow line. The connecting assembly also engages the connecting member such that it moves along the connecting member relative to the flotation device. With this arrangement, moving the connecting assembly along the connecting member effectively changes the point of attachment of the tow line to the flotation device. This connecting system by itself may provide the rider with limited steering capabilities on most commercially available flotation devices.

The present invention has particular significance in the context of an inner tube-type flotation device (and that application will be discussed herein in detail). These inner tube-type devices commonly comprise an inflatable, vinyl inner tube that is placed within a nylon cover. The tow line is attached to the cover, and the cover has a bottom portion that gives the entire assembly a flat bottom surface.

In this context, the connecting system described above is enhanced by providing one or more sponsons that extend from the inner tube device cover into the water. In the exemplary preferred form described herein, two sponsons are attached to the underside of the flotation device such that they define a channel extending between the front and back ends of the device. When the connecting assembly is slid from one side to the other of the connecting member, the sponsons act on the water in such a manner that the flotation device moves to one side or the other relative to the direction of travel of the boat.

The sponsons are preferably toed-in such that the channel defined between them diverges towards the rear of the device. This arrangement reduces drag and allows an inner-tube device to behave (e.g., slide to the side) like a standard inner-tube device.

Again in the context of an inner tube style flotation device, the rider will commonly sit in the inner tube with his or her feet hanging over the front end. In this position, it would be difficult for the rider to move the connecting assembly along the connecting member.

The present invention thus preferably further comprises a handle assembly that allows a sitting rider to easily move the connecting assembly along the connecting member. While it may be possible to connect a short line and handle directly to the connecting assembly, a preferable approach is to connect the handle line to the tow line at an intermediate point that is spaced from the connecting assembly. This can be accomplished by providing first and second handle lines attached together and to the tow line at the intermediate point. One of the handle lines is then attached to a tow rope through the connecting assembly, while the other is attached to a handle. The handle is preferably free-held.

By spacing the intermediate point from the connecting assembly as described, the handle line attached to the handle can be pulled from side to side to move the connecting assembly along the connecting member, but can be raised over the rider's feet when necessary.

The connecting member is, in one preferred embodiment, a rigid member that is bent such that it is smoothly and continuously curved from one end to the other. In the context of an inner tube, the ends of the connecting member are attached to the cover on either side of the tube such that the rigid member extends across the front of the tube.

The connecting assembly is adapted to be connected to the tow line and to move smoothly along the connecting member. Roller bearing assemblies may be provided to transfer loads from the connecting assembly to the connecting member but still allow the connecting assembly to move smoothly along the connecting member.

The sponsons may be attached to the underside of the flotation device by enclosing them in a sponson chamber defined by a portion of the cover. Fastening assemblies may be provided to more securely attach the sponson member to the cover.

The present invention thus creates a steerable flotation device. This allows the rider to perform stunts, such as jumping the wake, that would otherwise not be possible using standard inner tubes. This greatly increased the enjoyment of the rider, and does not require that the rider have a high level of skill.

DETAILED DESCRIPTION

Figure 1:
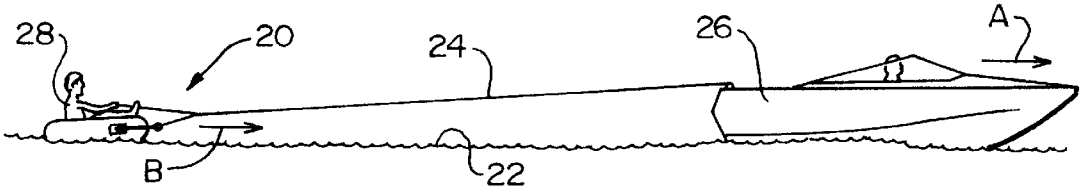
FIG. 1 is a side plan view showing a steerable, towable water device of the present invention in the environment in which it will commonly be used.

Referring now to the drawing, depicted therein at 20 is a water sport device constructed in accordance with, and embodying, the principles of the present invention. The device 20 floats on water 22 and is pulled by a tow line 24 connected to a watercraft such as a boat 26 as shown in FIG. 1. A rider 28 sits in or lies on the device 20.

Figure 13:
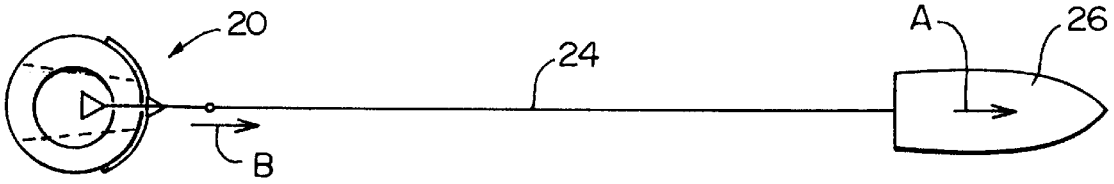
FIGS. 13–14 is a top plan view showing the water sport device of FIG. 1 in use.
Figure 14:
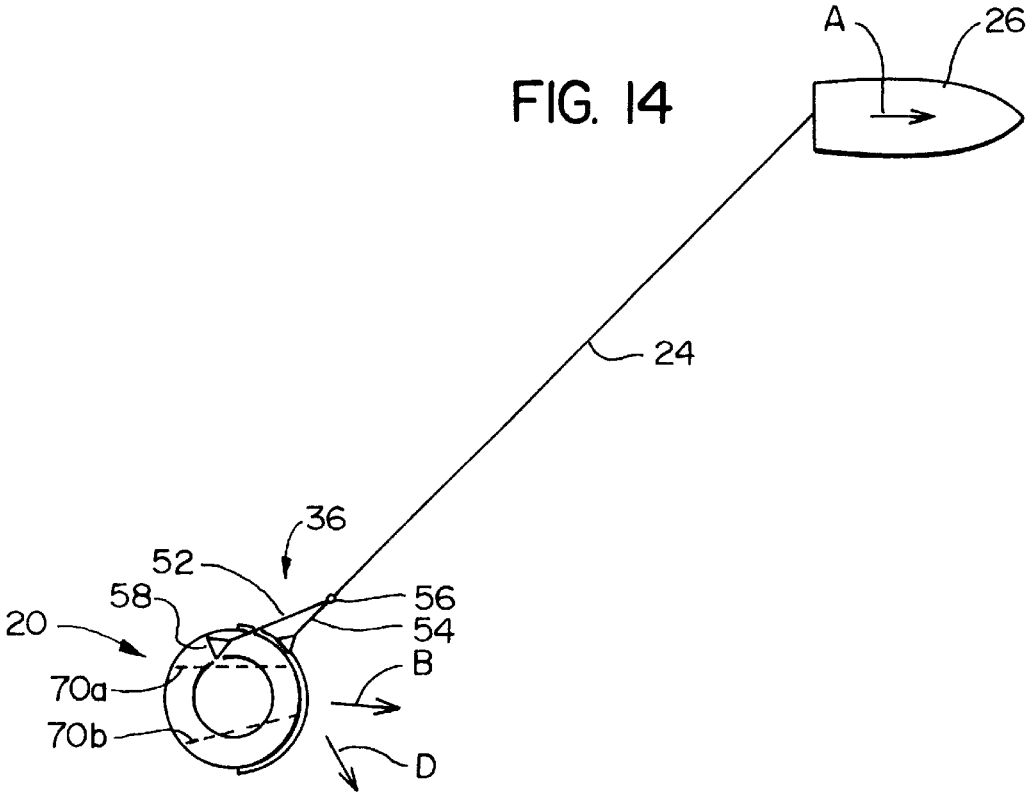

Referring now for a moment to FIGS. 13 and 14, it can be seen that the boat 26 moves in a direction indicated by arrows A while the water sport device 20 moves in a direction indicated by an arrow B. The water sport device 20 is constructed such that the float direction shown by arrow B may be changed relative to that of the boat direction shown by arrow A. This allows the rider to move the water sport device 20 from a center line position as shown in FIG. 13 to a side position as shown in FIG. 14. In so doing, the rider is able to jump the wake created by the boat 26.

In the following discussion, the term "front" refers to the direction shown by arrow B in FIG. 2, while the term "back" refers to the opposite direction. The terms "left side" and "right side" are relative to a rider sitting in the device 20 and facing the front. The terms "top" and "bottom" refer to those directions as shown in FIG. 3.

Figure 2:
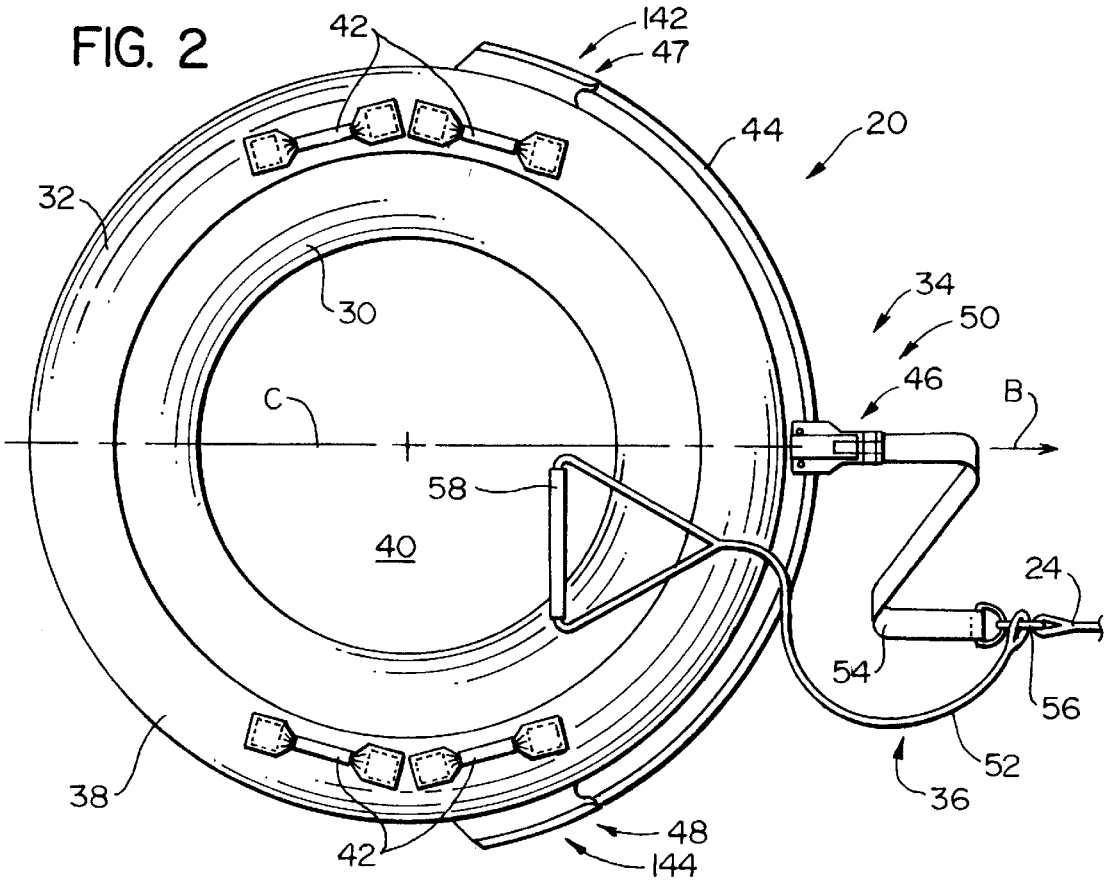
FIG. 2 is a top plan view of the water sport device shown in FIG. 1.
Figure 3:
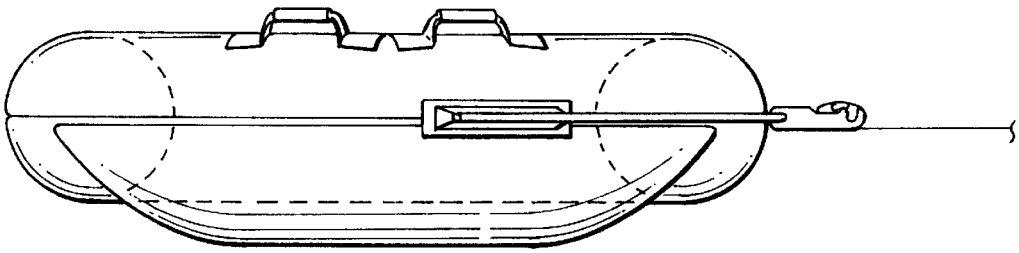
FIG. 3 is a side elevational view of the water sport device as shown in FIG. 1.

Additionally, the water sport device 20 defines a float center axis C that extends through to the front and back of the device 20 as shown in FIG. 2. The terms "horizontal" and "vertical" are, in the following discussion, relative to the watercraft 20; the terms "vertical" and "horizontal" will thus normally be substantially the same as true horizontal and vertical, but not necessarily.

Referring for a moment back to FIGS. 13 and 14, it can be seen that the tow line 24 extends at a boat angle relative to the boat direction shown by arrow A and a float angle relative to the float direction shown by arrow B. The boat angle and float angle may be zero as shown in FIG. 13 or may be non-zero as shown in FIG. 14.

With the foregoing frame of reference, the invention will now be described in further detail. As shown in FIG. 2, the water sport device 20 comprises an inner tube member 30, a cover 32, a connecting system 34, and a handle assembly 36.

The exemplary inner tube assembly 30 comprises a hollow vinyl ring and a valve assembly that allows pressurized air to be introduced into and removed from the ring. By inflating the ring to contain air at a given pressure, the entire device 20 can be made buoyant so that it supports the rider 28. While the inner tube assembly 30 is ring-shaped, teachings of the present invention may be used in connection with other shapes currently available in the marketplace.

The cover 32 comprises a ring portion 38 and a bottom portion 40. The ring portion 38 at least partially surrounds the inner tube assembly 30 to prevent relative movement between the cover 32 and the inner tube assembly 30. The bottom portion 40 is generally disc-shaped and forms a bottom wall of the device 20. Handles 42 are attached to the cover 32 on opposite sides of the center line C.

The connecting system 34 comprises a connecting member 44 and a connecting assembly 46. The connecting member 44 has first and second ends 47 and 48 that are attached to the cover 32 such that the member 44 extends along a front end portion 50 of the device 20.

The connecting assembly 46 is designed to transfer loads from the tow line 24 to the connecting member 44 yet still allow the connecting assembly 46 to move between the ends 46 and 48 of the connecting member 44.

The handle assembly 36 comprises a first handle line 52, a second handle line or strap 54, and a ring 56. The ring 56 connects one end of the handle lines 52 and 54 to the tow line 24. The other end of the first handle line 52 is connected to a handle 58. The other end of the second handle line 54 is connected to the connecting assembly 46.

Referring back for a moment to FIG. 14, the handle assembly 36 is shown therein in use. In use, the tow line 24 is in tension; the tow line 24 thus applies a load on the second handle line 54 through the ring 56. Under these conditions, the tow line 24 and second handle line 54 will be substantially co-linear as shown in FIGS. 13 and 14.

To change direction of the device 20, thereby moving from the position shown in FIG. 14 to that shown in FIG. 13, the handle 58 is swung in the direction shown by arrow D in FIG. 14 such that the first handle line 52 crosses over the second handle line 54. Pulling the handle 58 to the right will cause the device 20 to turn to the left, and vice versa.

More specifically, pulling the handle 58 to the right rotates the device 20 to the left relative to the tow line 24 such that the float direction of travel shown by arrow B moves in line with the tow line 24. The device 20 will then move sideways relative to the boat 26 until it reaches the position shown in FIG. 13. Of course, at this point the handle 58 can be manipulated such that the first tow line 52 moves to one side or the other of the second tow line 54 to cause the device 20 to move back to the position shown in FIG. 14 or to a similar position on the opposite side of the boat 26.

Referring now to FIGS. 3–8, depicted therein are first and second sponsons 60 and 62 that extend downwardly from a bottom portion 64 of the device 20. These sponsons 60 and 62 define a center channel 66. The exemplary sponsons 60 and 62 are symmetrically arranged on either side of the center line C such that the channel 66 is substantially parallel to the center line C.

The sponsons 60 and 62 are mirror images of each other, and only one of these will be explained in detail herein.

Figure 7:
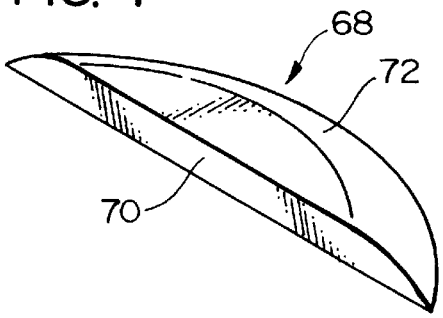
FIG. 7 is a bottom, perspective view of one of two exemplary sponson members employed by the water sport device of FIG. 1.
Figure 8:
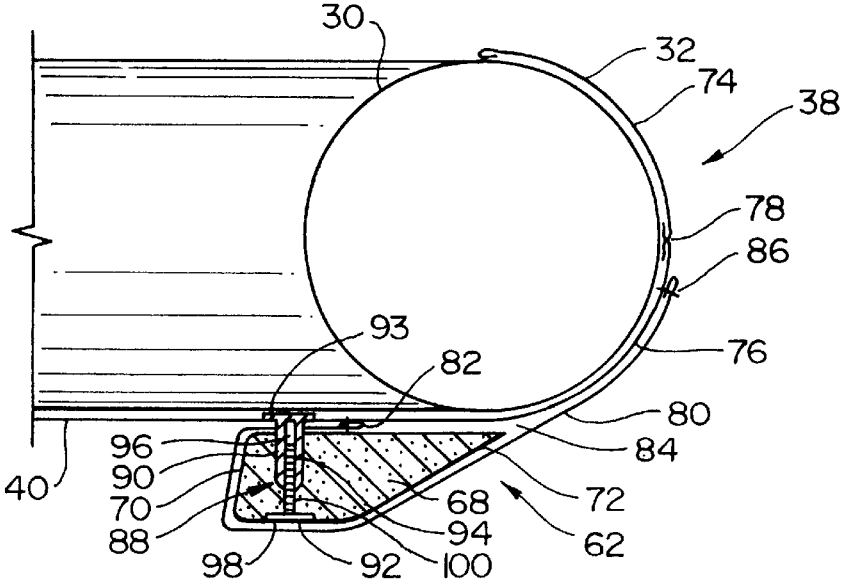
FIG. 8 is a front, partial sectional view taken along lines 8—8 in FIG. 4.

Referring for a moment to FIG. 8, it can be seen that the sponson 62 is formed by a sponson member 68 that is attached to the cover 32. The sponson member 68 defines the shape of the sponson 62 and is shown by itself in FIG. 7.

The sponson member 68 is a resilient, close-cell foam body that is flexible and may be shaped by cutting but retains its shape when loads encountered during normal use are applied thereon.

The sponson member 68 has an inner surface 70 and an outer surface 72. The inner surface 70 is generally planar and extends at a first sponson angle relative to vertical. The exemplary outer surface 72 is curved as shown in FIG. 7 but, as shown in FIG. 8, extends at a second angle relative to vertical. The curve of the outer surface 72 generally follows the curve of the circumference of the inner tube assembly 30. In other embodiments, the outer surface 72 may be curved less than the inner tube circumference and even may be almost straight in the middle.

Figure 4:
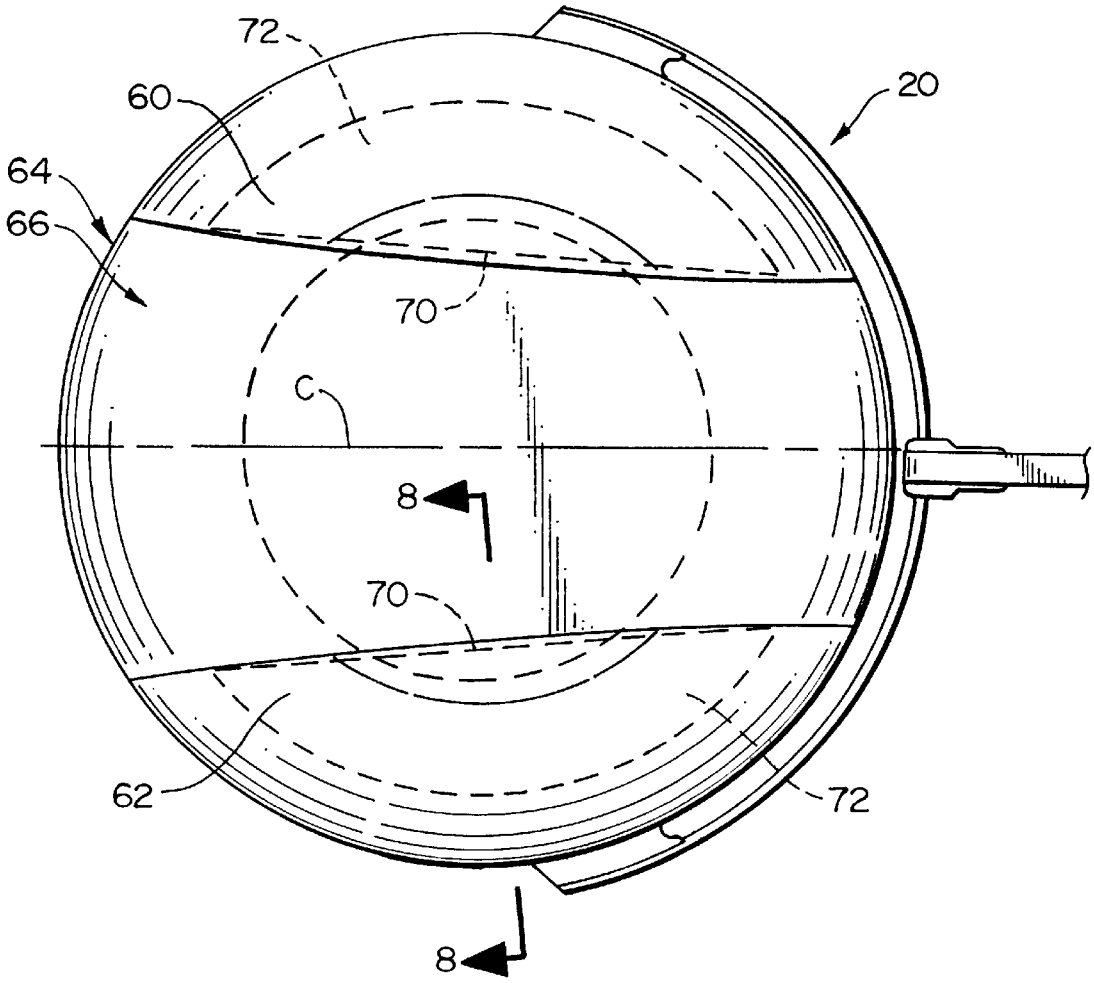
FIG. 4 is a bottom plan view of the water sport device of FIG. 1.
Figure 5:
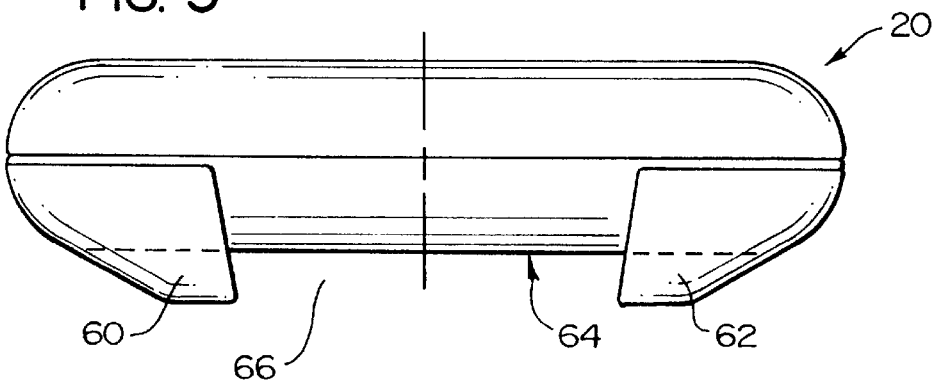
FIG. 5 is a rear elevational view of the water craft device of FIG. 1.
Figure 6:
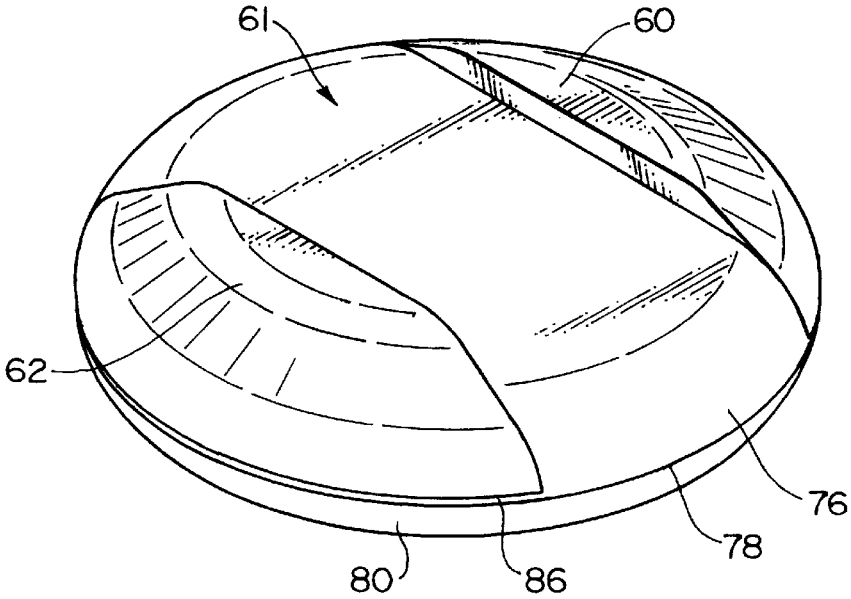
FIG. 6 is a bottom, perspective view of the water sport device of FIG. 1.

Additionally, as perhaps best shown in FIG. 4, the inner surfaces 70 extend at a third angle relative to the float center axis C.

The inner surfaces 70 are therefore canted rearwardly and outwardly with respect to the center axis C and downwardly and inwardly with respect to vertical. The inner surfaces 70 may be vertical or outwardly canted with respect to vertical, as well.

In addition to being curved, the outer surfaces 72 are canted outwardly and upwardly relative to vertical.

The shape of the exemplary sponsons 60 and 62 as provided by the sponson members 68 allows the sponsons 60 and 62 to perform the following functions. First, the outwardly and upwardly canted outer surfaces 72 allow the device 20 to move from side to side with less likelihood that an edge of the sponson will catch the water and cause the device 20 to roll in the direction in which it is moving. The inner surfaces 70 engage the water in a manner that causes the device 20 to move from side to side once the float center axis C has been moved out of alignment with the direction of travel as shown by arrow A.

The canting of these inner surfaces 70 with respect to the float center axis C reduces drag when the device 20 is off to one side of the boat 26 as shown in FIG. 14. In particular, the one of these surfaces that is closest to the boat 26, identified by reference character 70*a* in FIG. 14, is substantially parallel to the direction of the boat 26 as shown by arrow A. The inner surface 70*b* of the other sponson is canted rearwardly and outwardly with respect to the direction shown by arrow A. Thus, neither of these surfaces 70*a* or 70*b* will create a substantial amount of drag; to the contrary, water moving relative to the device 20 from the front to the rear passes through the channel 66, which diverges, or effectively increases in size, towards the rear of the device 20.

While the exemplary sponson member 68 has been designed to operate effectively within the context of the watersport device 20, the exact shape of the sponson member is not critical. This shape may be altered depending on such factors as the type of float assembly onto which the sponson is to be attached, the type of ride desired, the skill level of the rider, and the like. For example, the inner surfaces thereof may be canted downwardly and outwardly. Accordingly, the details of the sponson member may vary depending upon the specific situation in which it is to be used.

Referring now for a moment back to FIG. 8, it can be seen that the sponson member 68 is attached to the cover 32. This attachment is accomplished as follows. As described above, the cover 32 comprises a ring portion 38 and a disc-shaped bottom portion 40. These can be formed by a number of methods, but in the exemplary device 20, these are formed by a top panel 74 and a bottom panel 76 sewn together along a seam 78.

To attach the sponsons, the cover 32 is provided with a sponson panel 80 that is sewn to the bottom panel 76 at a seam 82. The sponson panel 80 is then folded over the sponson to define a sponson chamber 84 in which the sponson member 68 is contained. Another edge of the sponson panel 80 is then sewn to the bottom panel 76 at a seam 86 adjacent to the seam 78.

In the exemplary cover 32, the seam 78 is formed at approximately half way from the bottom to the top of the inner tube member 30. The seam 86 is formed slightly below the seam 78 such that the seam 86 is spaced almost half way up the height of the inner tube assembly 30. By arranging this seam 86 substantially above the bottom portion 40, the likelihood that water will be forced into the sponson chamber 84 is substantially decreased. The seam 86 may be placed closer to or under the water line, as the water is not allowed to flood the sponson chamber 84, because the solid sewing (no gaps between stitches) will form an effective seal at the seam 86.

The sewn sponson panel 80 described above may be sufficient in many circumstances to provide a secure attachment of the sponson member 68 to the cover 32. In addition, however, fastening assemblies 88 may be employed. These assemblies 88 comprise a base member 90 and a peg member 92. The base member 90 comprises a flange 93 and a shaft 94 that defines a cavity 96. The peg 92 has a head flange 98 and a toothed shaft 100. The shaft 100 is sized and dimensioned to fit within the cavity 96 defined by the base member 90. The teeth on this shaft 70 allow the shaft to enter the chamber 96 to the proper depth, but prevent withdrawal of this shaft without damaging either the peg member 92 or the base member 90. An adhesive may also be used to secure the connection between the base member 90 and the peg member 92.

During manufacture of the device 20, the shaft portion 94 of the base member 90 is inserted through holes in the bottom panel 76 and the sponson panel 80. The shaft 94 is then further inserted into a hole in the sponson member 68. The flange 93 prevents the base member 92 from being withdrawn through the holes in the bottom panel 76 and the sponson panels 76 and 80.

The peg member 92 is then inserted through the hole in the sponson 68 into the cavity 96 such that relative movement of the peg 92 away from the base member 90 is prevented. The head flange 98 on the peg 92 engages the sponson member 68 to fix the sponson member 68 relative to the base member 90 and thus the bottom panel 76. The step of attaching the sponson member 68 to the cover 32 is performed before the step of forming the seam 86 so that the peg head flange 98 is not exposed.

A number of such fastening assemblies 88 will normally be employed, with five of these being spaced along each of the sponson members 68 in the exemplary device 20.

Figure 9:
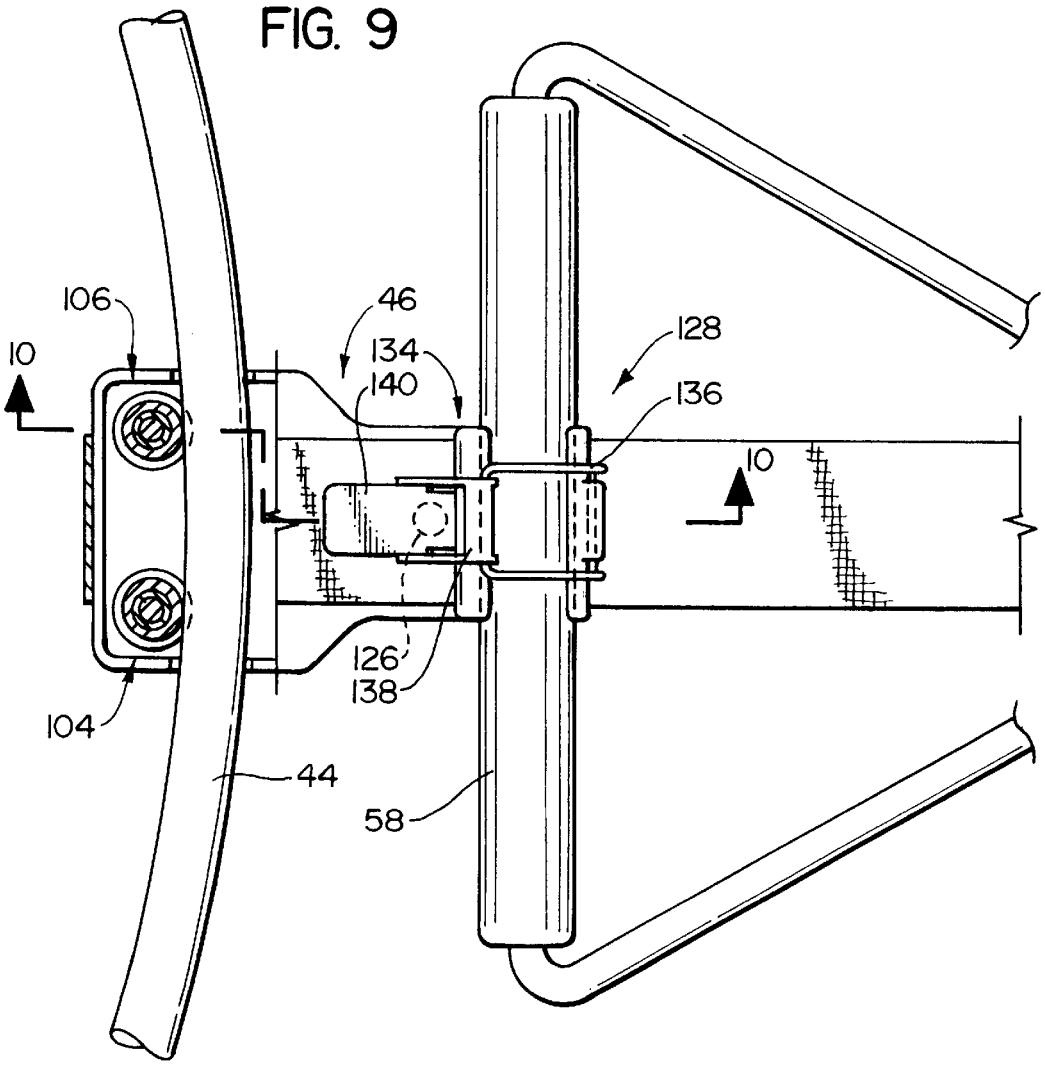
FIG. 9 is a to plan, partial cut-away view showing details of a connecting member and connecting assembly of the device shown in FIG. 1.
Figure 10:
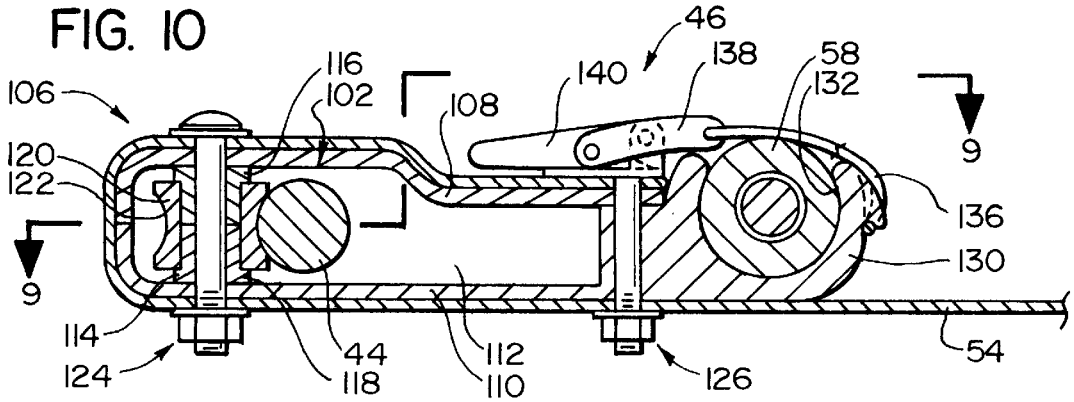
FIG. 10 is a cut-away view taken along lines 10—10 in FIG. 9.

Referring now to FIGS. 9–10, the connecting assembly 46 will be described in further detail. The connecting assembly 46 comprises a housing assembly 102 and first and second roller assemblies 104 and 106. The housing assembly 102 comprises an upper portion 108 and a lower portion 110. When fastened together, these portions 108 and 110 define a cavity 112 in which the connecting member 44 is contained. The roller assemblies 104 and 106 are similarly contained in this chamber 112.

The roller assemblies 104 and 106 are identical, and only one of these will be described herein in detail.

As shown in FIG. 10, the roller assembly 106 comprises a shaft 114 formed by a pair of shaft projections 116 and 118 extending inwardly from the upper and lower housing members 108 and 110, respectively. The roller assembly 106 further comprises a roller member 120 that is disposed over the shaft 114. The roller member 120 is generally in the shape of a hollow cylinder and, when mounted on the shaft 114, is coaxially aligned with the shaft 114. The roller member 120 is, however, free to rotate about its longitudinal axis relative to the shaft 114.

An annular groove 122 is formed on the surface of the roller member 120 to guide the connecting member 44, which in the exemplary device 20 has a circular cross-sectional area, into a desired contact with the roller member 120.

A bolt assembly 124 extends through the shaft 114. This bolt assembly 124 forms part of the attachment system that holds the upper and lower portions 108 and 110 of the housing assembly 102 together. The bolt members of the bolt assembly 124 further strengthen the shaft 114. It may be possible to eliminate the shaft 114 such that the roller member 120 bears directly on the bolt assembly 124.

A third bolt assembly 126 is provided to complete the attachment of the housing portions 108 and 110 to each other.

In the exemplary connecting assembly 46, the bolt assemblies 124 and 126 are employed to fasten the second handle line 54 to the connecting assembly 46. In particular, the second handle line 54 is a flat, elongate strap that extends along a lower surface of the bottom housing portion 110, around the back end of the housing assembly 102, and along an upper surface of the upper housing portion 108. The strap line 54 extends under washers of the bolt assemblies 124 and 126 with the second handle line 54 being clamped between these washers and thus to the housing assembly 102.

As briefly described above, the rider 28 will commonly sit in the device 20, but may also lay on top of the device 20. In this case, it would be difficult to use the handle 58 as described above to move the point at which the connecting assembly is positioned relative to the connecting member 44.

A latch assembly 128 may thus be provided on the connecting assembly 46 to allow the handle 58 to be secured to the connecting assembly 46. The handle 58 will thus not be in the way when the rider is lying flat on top of the device 20 and can be grabbed and moved from side to side to move the connecting assembly 46 relative to the connecting member 44.

The latch assembly 128 comprises a latch projection 130 formed on the upper housing member 108. This latch projection 130 defines a groove 132 designed to accommodate the handle 58. It may be possible to design the projection 130 and handle 58 such that a friction fit is established that is sufficient to hold the handle 58 in place.

But the exemplary latch assembly 128 further comprises an over the center assembly 134 having a loop portion 136 that engages the latch projection 130 to secure the handle 58 in the groove 132. The loop member 136 is attached to a linkage 138 which is in turn attached to a lever 140.

With the loop member 136 firmly engaged with the latch portion 130, rotating the handle portion 140 into its locked position as shown in FIG. 10 securely retains the handle 58 in the groove 132. The lever member 140 is simply rotated upwardly to release tension on the loop member 136, at which point the loop member 136 can be disengaged from the latch portion 130.

Referring again for a moment to FIG. 2, it can be seen that the ends 47 and 48 of the connecting member 44 are attached to the cover 32 by attachment assemblies 142 and 144. These assemblies 142 and 144 are identical, and only the assembly 144 will be described herein in detail.

Figure 11:
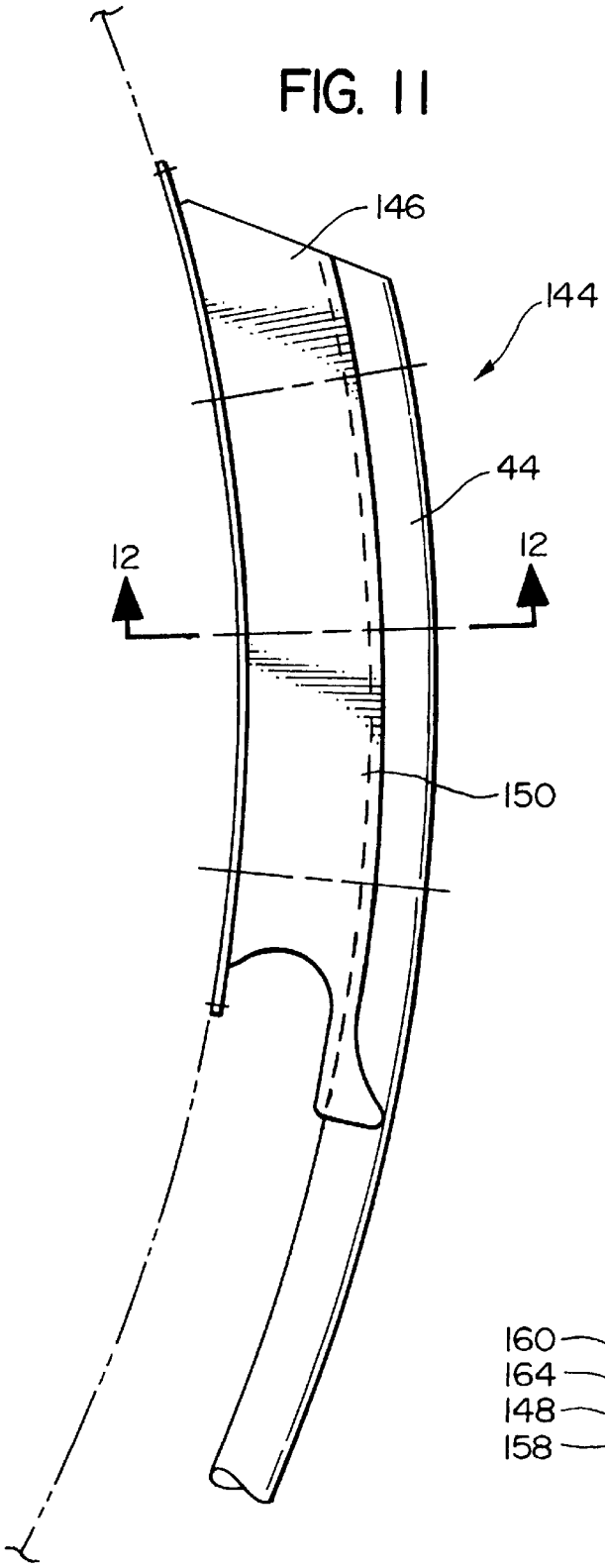
FIG. 11 is a top plan view of an assembly that is used to attach a connecting member to a cover of the water sport device of FIG. 1.
Figure 12:
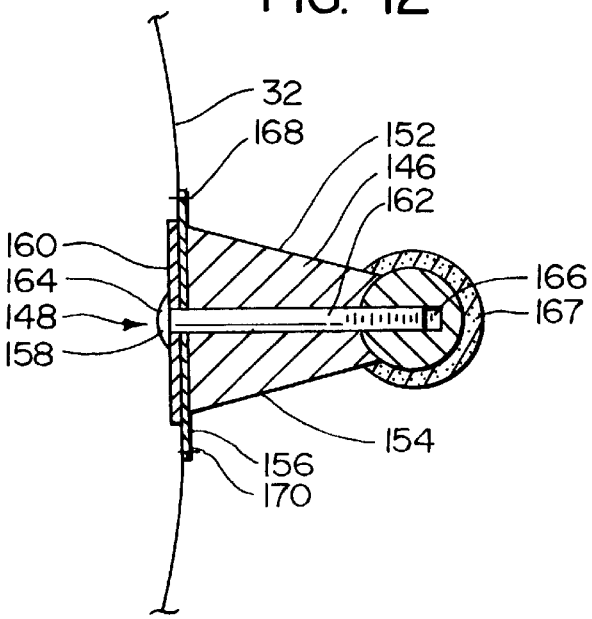
FIG. 12 is a cut-away view taken along lines 12—12 in FIG. 11.

FIGS. 11–12 depict the attachment assembly 144. In particular, this assembly 144 comprises a spacing member 146 and a plurality of bolt assemblies 148 (FIG. 12). The spacing member 146 has an outer perimeter groove 150 that is shaped and contoured to conform to the shape and curve of the connecting member 44. The spacing member 146 also has upwardly and inwardly slanting upper surfaces 152 and 154. Thick strapping material 156 is sewn to the cover 32 to reinforce the cover 32 against the bolt assemblies 148 pulling through the cover 32.

The bolt assembly 148 comprises a bolt 158 and a washer member 160. The bolt 158 has a shaft 162 and a head 164. The shaft 162 is passed through a hole in the washer member 160 and through the spacer member 146, into a threaded chamber 166 formed in the connecting member 44.

A foam handle cover 167 may be placed over the attachment assembly 144 such that it extends partially over the connecting member 44 and the spacing member 146.

The attachment assemblies 142 and 144 thus securely attach the ends 47 and 48 of the connecting member 44 to the cover 32 at opposite sides of the center line C. These attachment assemblies 142 and 144 also provide the user with a hand grip that may be used when the rider is lying down. The handle cover (not shown) facilitates gripping of the attachment assembly 144.

Referring now to FIGS. 15–18, depicted therein is yet another exemplary water sport device 220 that is constructed in accordance with, and embodies, the principles of the present invention. The device 220 operates in a manner that is almost exactly the same as the device 20 described above. The primary difference between these devices 20 and 220 is in the implementation of the connecting member and connecting assembly, with other parts being slightly modified to accommodate the changes to the connecting member and the connecting assembly. The device 220 will be described below only to the extent that it differs from the device 20 described above.

Figure 15:
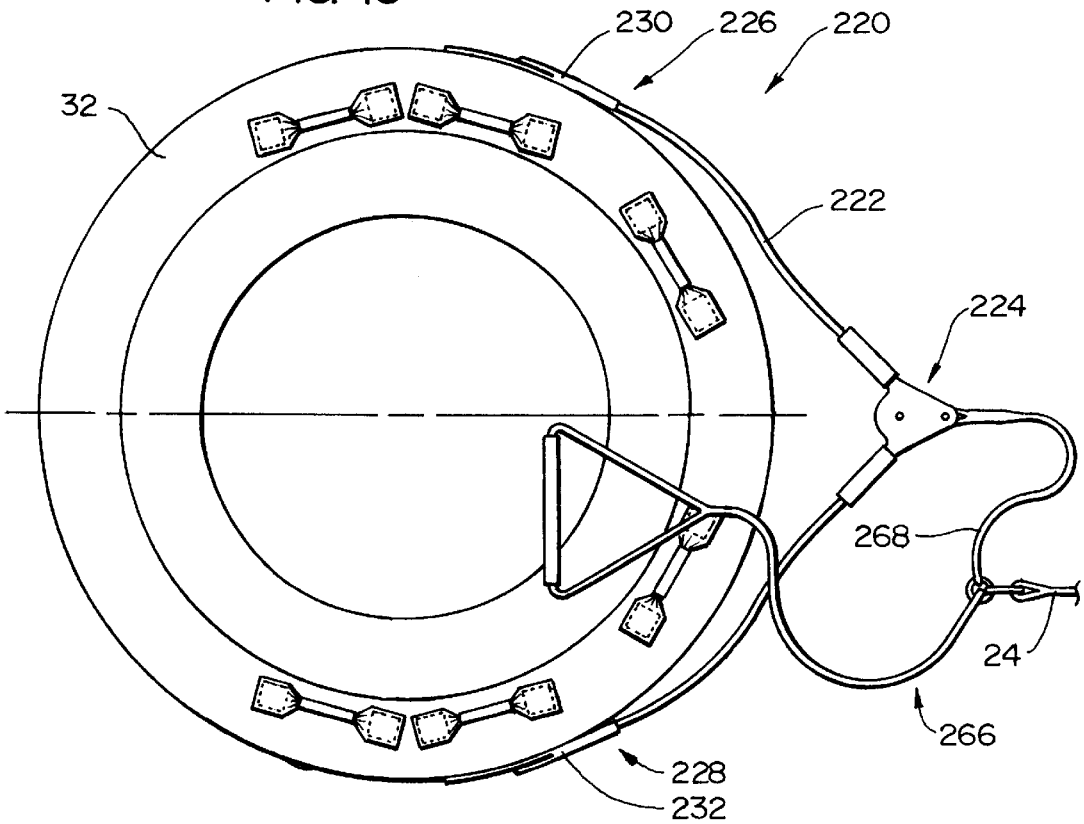
FIG. 15 is a top plan view of a second embodiment of a water craft device that may be used as shown in FIG. 1.
Figure 16:
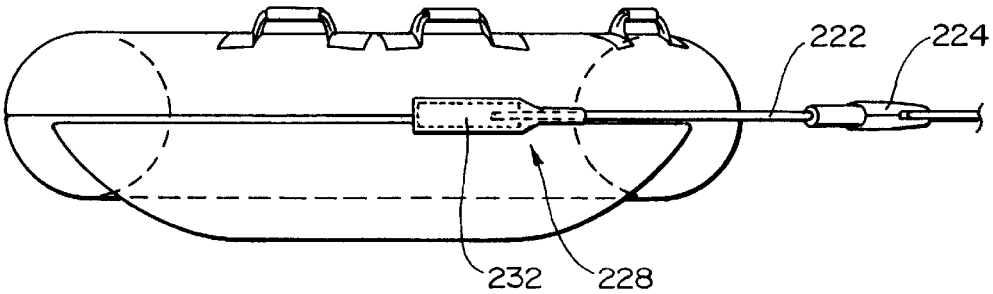
FIG. 16 is a side elevational view of the water sport device shown in FIG. 15.

FIG. 15 shows that the device 220 comprises a connecting member 222 and a connecting assembly 224. The connecting member 222 is, unlike the connecting member 44 described above, flexible rather than rigid. The connecting member 222 may be a length of line such as rope, cable, or the like. Ends 226 and 228 of the connecting member 222 are attached to the cover 32 by attachment panels 230 and 232. These panels 230 and 232 are sewn to the member 220 and the cover 32.

Figure 17:
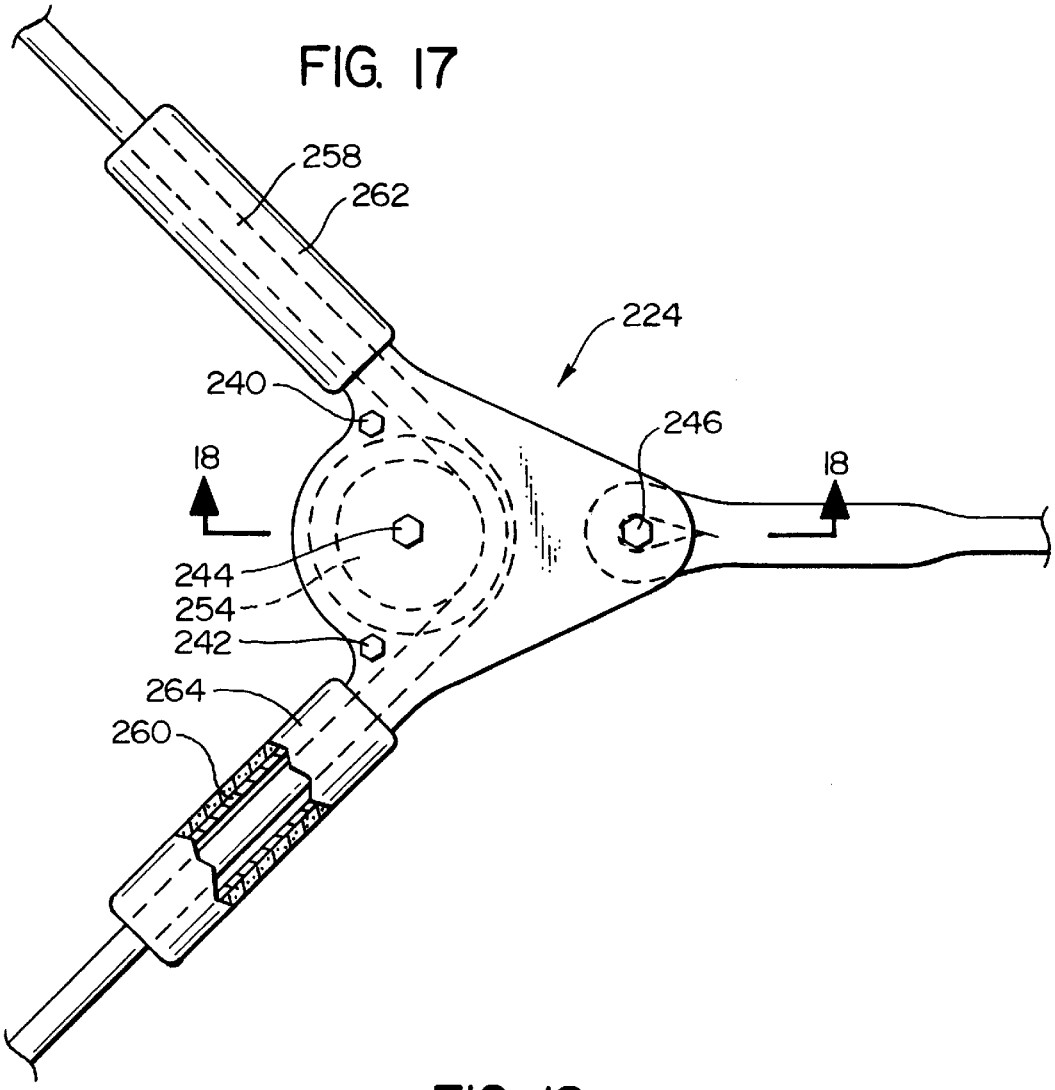
FIG. 17 is a top, plan, partial cut-away view of a connecting member and connecting assembly of the device shown in FIG. 15.

The connecting assembly 224 may be moved along the connecting member 222 between its ends 226 and 228. More specifically, as shown in FIG. 17, the connecting assembly 224 comprises a housing assembly 234 having an upper portion 236 and a lower portion 238. These portions 236 and 238 are connected by bolts 240, 242, 244, and 246. When connected as described, the housing assembly defines a center chamber 248 through which the connecting member 222 extends.

Figure 18:
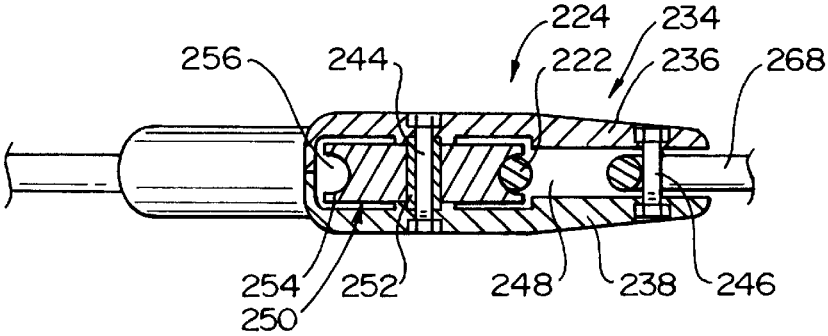
FIG. 18 is a cut-away view taken along lines 18—18 in FIG. 17.

Also provided in this chamber 248 is a roller assembly 250. This roller assembly 250 has a shaft 252, a roller member 254, and rotates about an axis defined by the bolt assembly 244. An annular groove 256 is formed in an outer surface of the roller member 254. This groove 256 is sized and dimensioned to receive the connecting member 222 as shown in FIG. 18.

The purpose of the roller member is to rotate relative to the housing assembly 234 and thereby more easily allow the connecting assembly 224 to be moved relative to the connecting member 222. In this context it should be noted that the smaller the diameter of the roller member 254, the more difficult this movement will be. With a small diameter, the connecting member 222 tends to wrap around the roller member 254 thus making it more difficult to pull the connecting assembly 224 from side to side relative to the member 222.

Thus, simply increasing the diameter of the roller member 254 may make movement of the connecting assembly 224 along the connecting member 222 easier. Another way of effectively increasing the diameter is to provide several smaller roller members that are arranged such that, when the connecting member 222 passes over a number of these, it extends substantially in an arc having the desired larger diameter. Thus, while one roller assembly 250 is shown in FIG. 18, a number of these may be provided depending on the specific implementation of the connecting assembly 224.

The housing assembly 234 comprises first and second side portions 258 and 260 that extend on either side of the roller assembly 250. The connecting member 222 also extends through these portions 258 and 260.

In the exemplary connecting assembly 224, these portions 258 and 260 extend at approximately right angles relative to each other; the angle between these may be increased, however, to help provide a greater effective diameter of the roller member 254.

Handle members 262 and 264 are placed over the portions 258 and 260 to allow the user to grip the assembly 224.

Referring now for a moment back to FIG. 15, it can be seen that the device 220 is provided with a handle assembly 266 that is similar to the handle assembly 36 described above, but which comprises a second handle line 268 that is a conventional line rather than a flat strap. In this case, the line 268 is passed around the frontmost bolt assembly 246 (as shown in FIG. 15) to fasten this line 268 to the connecting assembly 224.

In most respects, the device 220 will operate in the same manner as the device 20 described above. The primary difference between these being that the device 220 might not be turned as easily as the device 20 but would be less expensive to manufacture.

In an alternative form, the devices 20 and 220 may be provided, in place of the connecting assemblies 46 and 224 described above, with a simple hook or clip that is capable of transferring loads on the towline 24 to the members 44 and 222. A hook or clip would not have the advantage provided by the rollers used in the assemblies 46 and 224, but would similarly function to allow the point of attachment of the towline to the connecting member to be changed. A simple hook or clip would also be less expensive to manufacture and maintain than the assemblies 46 and 224.

It should therefore be recognized that various modifications can be made without departing from the basic teaching of the present invention. The above-described embodiments are therefor to be considered in all respects illustrative and not restrictive, the scope of the invention being indicated by the appended claims rather than the foregoing description. All changes that come within the meaning and scope of the claims are intended to be embraced therein.

I claim:

1. A water sport device that is towed from a towline attached to a water craft moving in a craft direction of travel, comprising:

a float assembly adapted to support a person on water when towed, the float assembly having a front end portion, a rear end portion, first and second side portions, a top portion, a bottom portion, and a float center axis extending through the rear end portion and the front end portion;

a connecting member having first and second ends;

first attachment means for attaching the connecting member to the float assembly such that the connecting member extends along the front portion of the float assembly;

connecting means movably mounted on the connecting member for transferring loads from the towline to the float assembly through the connecting member and the attachment means; and a handle assembly securely attached to the towline at an intermediate point, the handle assembly comprising a first handle line, a second handle line, first fastening means for attaching the first handle line, the second handle line, and the towline together at the intermediate point, a handle member attached to the first handle line, and second fastening means for attaching the second handle line to the connecting means; wherein moving the connecting means between the first and second ends of the connecting member allows an angle between the craft direction of travel and the float center axis to be changed; and when the towline is under tension, the intermediate point is spaced a predetermined distance from the connecting means.

2. A water sport device as recited in claim 1 in which the connecting means further comprises handle attachment means for allowing the handle member to be selectively attached to the connecting means.

3. A water sport device that is towed from a towline attached to a water craft moving in a craft direction of travel, comprising:

a float assembly comprising an inflatable member and adapted to support a person on water when towed, the float assembly having a front end portion, a rear end portion, first and second side portions, a top portion, a bottom portion, and a float center axis extending through the rear end portion and the front end portion;

a connecting member having first and second ends;

first attachment means for attaching the connecting member to the float assembly such that the connecting member extends along the front portion of the float assembly;

connecting means movably mounted on the connecting member for transferring loads from the towline to the float assembly through the connecting member and the attachment means;

at least one sponson member; and second attachment means for attaching the sponson member to the bottom portion of the float assembly such that the sponson member extends into the water, the second attachment means comprising a cover that at least partially surrounds the inflatable member and a plurality of fastening assemblies that extend through the cover and the sponson member to attach the sponson member to the cover; wherein moving the connecting means between the first and second ends of the connecting member allows an angle between the craft direction of travel and the float center axis to be changed;

as the connecting means is moved between the first and second ends of the connecting member, the sponson member acts on the water such that float assembly moves through the water in a float direction of travel; and loads on the sponson member are transferred to the inflatable member through the fastening assemblies and the cover.

4. A water sport device as recited in claim 3, in which the inflatable member is in the shape of a hollow ring and the cover comprises:

a ring portion adapted to at least partially surround the inflatable member;

a disc portion that extends under the inflatable member; and an envelope portion having a first edge attached to the disc portion and a second edge attached to the ring portion to define a sponson chamber; wherein the sponson member is contained in the sponson chamber.

5. A water sport device as recited in claim 3, in which each fastening assembly comprises a peg member and a base member defining a base cavity, where the peg member engages a portion of the base member defining the base cavity to form the fastening assembly.

6. A water sport device as recited in claim 5, in which the base member extends through the disc and envelope portions of the cover and at least partially through the sponson member, and the peg member extends at least partially through the sponson member to engage the base member.

7. A water sport device that is towed from a towline attached to a water craft moving in a craft direction of travel, comprising:

an inflatable float assembly adapted to support a person on water when towed, the float assembly having a front end portion, a rear end portion, first and second side portions, a top portion, a bottom portion, and a float center axis extending through the rear end portion and the front end portion;

a connecting member having first and second ends;

first and second sponson members;

cover means for attaching the connecting member and first and second sponson members to the inflatable assembly such that the connecting member extends along the front portion of the float assembly and the sponson members downwardly extend from the bottom portion of the float assembly;

a connecting means movably mounted on the connecting member, where the connecting means is connected to the towline such that loads on towline are transferred to the float assembly through the connecting means, the connecting member, and the attachment means; and a handle assembly securely attached to the towline at an intermediate point, where the handle assembly comprises a first handle line, a second handle line, first fastening means for attaching the first handle line, the second handle line, and the towline together at the intermediate point, a handle member attached to the first handle line, and second fastening means for attaching the second handle line to the connecting means; wherein moving the connecting means between the first and second ends of the connecting member allows an angle between the craft direction of travel and the float center axis to be changed; and when the towline is under tension, the intermediate point is placed a predetermined distance form the connecting means.

8. A water sport device as recited in claim 7, in which the connecting means further comprises handle attachment means for allowing the handle member to be selectively attached to the connecting means.

9. A water sport device that is towed from a towline attached to a water craft moving in a craft direction of travel, comprising:

an inflatable float assembly in the shape of a hollow ring, where the inflatable float assembly is adapted to support a person on water when towed, the float assembly having a front end portion, a rear end portion, first and second side portions, a top portion, a bottom portion, and a float center axis extending through the rear end portion and the front end portion;

a connecting member having first and second ends;

first and second sponson members;

cover means for attaching the connecting member and first and second sponson members to the inflatable assembly such that the connecting member extends along the front portion of the float assembly and the sponson members downwardly extend from the bottom portion of the float assembly, the cover means comprising a ring portion adapted to at least partially surround the inflatable member, a disc portion that extends under the inflatable member, and first and second envelope portions each having a first edge attached to the disc portion and a second edge attached to the ring portion to define first and second sponson chamber, where the connecting member is attached to the ring portion, and the first and second sponson members are contained in the first and second sponson chambers, respectively;

a connecting means movably mounted on the connecting member, where the connecting means is connected to the towline such that loads on towline are transferred to the float assembly through the connecting means, the connecting member, and the attachment means; wherein moving the connecting means between the first and second ends of the connecting member allows an angle between the craft direction of travel and the float center axis to be changed.

10. A water sport device adapted to be towed from a towline attached to a water craft moving in a craft direction of travel, comprising:

an inflatable tube adapted to be filled with pressurized air to support a person in water;

a cover that surrounds a substantial portion of the inflatable tube such that loads applied to the cover are transferred to the inflatable tube;

a connecting member having first and second ends;

first and second spacing members;

fastening means for attaching the first and second ends of the connecting member to the cover through the first and second spacing members such that the spacing members locate the connecting member at a desired location relative to the inflatable tube and loads applied to the connecting member are transferred to the cover; and a connecting assembly adapted to be connected to the tow line, where the connecting assembly engages the connecting member such that the connecting assembly may be moved between the first and second ends of the connecting member and loads on the tow line are transferred to the connecting member.

11. A water sport device as recited in claim 10, in which the fastening means comprises a plurality of bolts that extend through the first and second spacing members and are threaded into the first and second ends of the connecting member.

12. A water sport device as recited in claim 10, further comprising means for reinforcing the cover where the fastening means are attached to the cover.

13. A water sport device adapted to be towed from a towline attached to a water craft moving in a craft direction of travel, comprising:

an inflatable tube adapted to be filled with pressurized air to support a person in water;

first and second sponson members, where each sponson member comprises substantially vertical face and a canted face;

a cover assembly that surrounds a substantial portion of the inflatable tube such that loads applied to the cover are transferred to the inflatable tube;

first and second sponson panels sewn to the cover assembly to define first and second sponson chambers, where the first and second sponsons are sewn within the first and second sponson chambers with the substantially vertical faces opposing each other and the canted faces facing outwardly; and connecting means adapted to be connected to the tow line, where the connecting means transfers loads on the tow line to the cover assembly.

14. A water sport device as recited in claim 13, in which the connecting means comprises:

a connecting member having first and second ends, where the connecting member is attached to the cover such that loads on the connecting member are transferred to the cover; and a connecting assembly adapted to be connected to the tow line, where the connecting assembly engages the connecting member such that the connecting assembly may be moved between the first and second ends of the connecting member and loads on the tow line are transferred to the connecting member.

15. A water sport device as recited in claim 14, in which the connecting means further comprises:

first and second spacing members; and fastening means for attaching the first and second ends of the connecting member to the cover through the first and second spacing members such that the spacing members locate the connecting member at a desired location relative to the inflatable tube.

16. A water sport device adapted to be towed from a towline attached to a water craft moving in a craft direction of travel, comprising:

an inflatable tube adapted to be filled with pressurized air to support a person in water, the inflatable tube defining a front portion, a rear portion, and a float center axis extending through the front and rear portions;

first and second sponson members, where each sponson member comprises substantially vertical face and a canted face;

a cover assembly that surrounds a substantial portion of the inflatable tube such that loads applied to the cover are transferred to the inflatable tube, and defines first and second sponson chambers, where the first and second sponsons are sewn within the first and second sponson chambers such that the substantially vertical faces are spaced from and oppose each other on opposite sides of the float center axis, the substantially vertical faces are angled slightly towards the float center axis, and the canted faces face outwardly; and connecting means adapted to be connected to the tow line, where the connecting means transfers loads on the tow line to the cover assembly.

17. A water sport device as recited in claim 16, in which the canted faces of the sponson members are contoured to substantially extend the curvature of the inflatable tube.

18. A water sport device as recited in claim 16, in which the substantially vertical faces of the sponson members are substantially planar.

19. A water sport device as recited in claim 16, further comprising fastening assemblies that extend through the cover assembly and the sponson members to strengthen the attachment of the sponson members to the cover assembly.

20. A water sport device as recited in claim 19, in which the fastening assemblies comprise:

a base member defining a cavity; and a peg member a textured portion that may be inserted into but not removed from the cavity in the base member.

21. A water sport device as recited in claim 16, in which the connecting means comprises:

a connecting member having first and second ends, where the connecting member is attached to the cover such that loads on the connecting member are transferred to the cover; and a connecting assembly adapted to be connected to the tow line, where the connecting assembly engages the connecting member such that the connecting assembly may be moved between the first and second ends of the connecting member and loads on the tow line are transferred to the connecting member.

22. A water sport device as recited in claim 21, in which the connecting means further comprises:

first and second spacing members; and fastening means for attaching the first and second ends of the connecting member to the cover through the first and second spacing members such that the spacing members locate the connecting member at a desired location relative to the inflatable tube.

* * * * *